United States Patent [19]

Geenen et al.

[11] 4,152,154

[45] May 1, 1979

[54] METHOD OF OPTICALLY PROJECTING A PATTERN OF SUBSTANTIALLY CIRCULAR APERTURES ON A PHOTOSENSITIVE LAYER BY ROTATING LIGHT SOURCE

[75] Inventors: Constant J. M. Geenen; Johannes C. A. Van Nes, both of Eindhoven, Netherlands

[73] Assignee: U.S. Philips Corporation, New York, N.Y.

[21] Appl. No.: 816,959

[22] Filed: Jul. 19, 1977

Related U.S. Application Data

[63] Continuation of Ser. No. 645,933, Jan. 2, 1976, abandoned, which is a continuation of Ser. No. 494,816, Aug. 5, 1974, abandoned, which is a continuation of Ser. No. 355,273, Apr. 27, 1973, abandoned, which is a continuation of Ser. No. 148,502, Jun. 1, 1971, abandoned.

[30] Foreign Application Priority Data

Jun. 5, 1970 [NL] Netherlands ..... 7008184
Feb. 17, 1971 [NL] Netherlands ..... 7102077

[51] Int. Cl.[2] ..... G03C 5/00

[52] U.S. Cl. ..... 96/36.1; 96/27 E; 354/1; 427/68

[58] Field of Search ..... 46/27 R, 27 E, 36.1; 354/1; 427/64, 68

[56] References Cited

U.S. PATENT DOCUMENTS

| | | | |
|---|---|---|---|
| 3,109,116 | 10/1963 | Epstein et al. | 313/408 |
| 3,211,062 | 10/1965 | Kaplan | 354/1 |
| 3,380,354 | 4/1968 | Thornton | 354/1 |
| 3,499,372 | 3/1970 | Staunton | 313/472 |
| 3,581,136 | 5/1971 | Staunton | 313/472 |
| 3,615,460 | 10/1971 | Lange | 96/36.1 |
| 3,667,947 | 6/1972 | McKee | 354/1 |
| 3,725,106 | 4/1973 | Hosokoshi | 96/36.1 X |
| 3,783,754 | 1/1974 | Takemoto et al. | 96/36.1 |
| 3,853,560 | 12/1974 | Ohgoshi et al. | 96/36.1 |
| 3,917,794 | 11/1975 | Akagi et al. | 427/68 |
| 3,993,487 | 11/1976 | Hosokoshi et al. | 96/36.1 |
| 4,001,018 | 1/1977 | Tsuneta | 96/36.1 |
| 4,013,467 | 3/1977 | Hosokoshi et al. | 96/36.1 |

*Primary Examiner*—Edward C. Kimlin
*Attorney, Agent, or Firm*—Algy Tamoshunas

[57] ABSTRACT

A window part for a color CRT is coated with a photosensitive layer which is exposed through the apertures of a shadow mask to a rotating light source having a direction of greatest light intensity directed to the center of rotation.

5 Claims, 7 Drawing Figures

Figure 1:
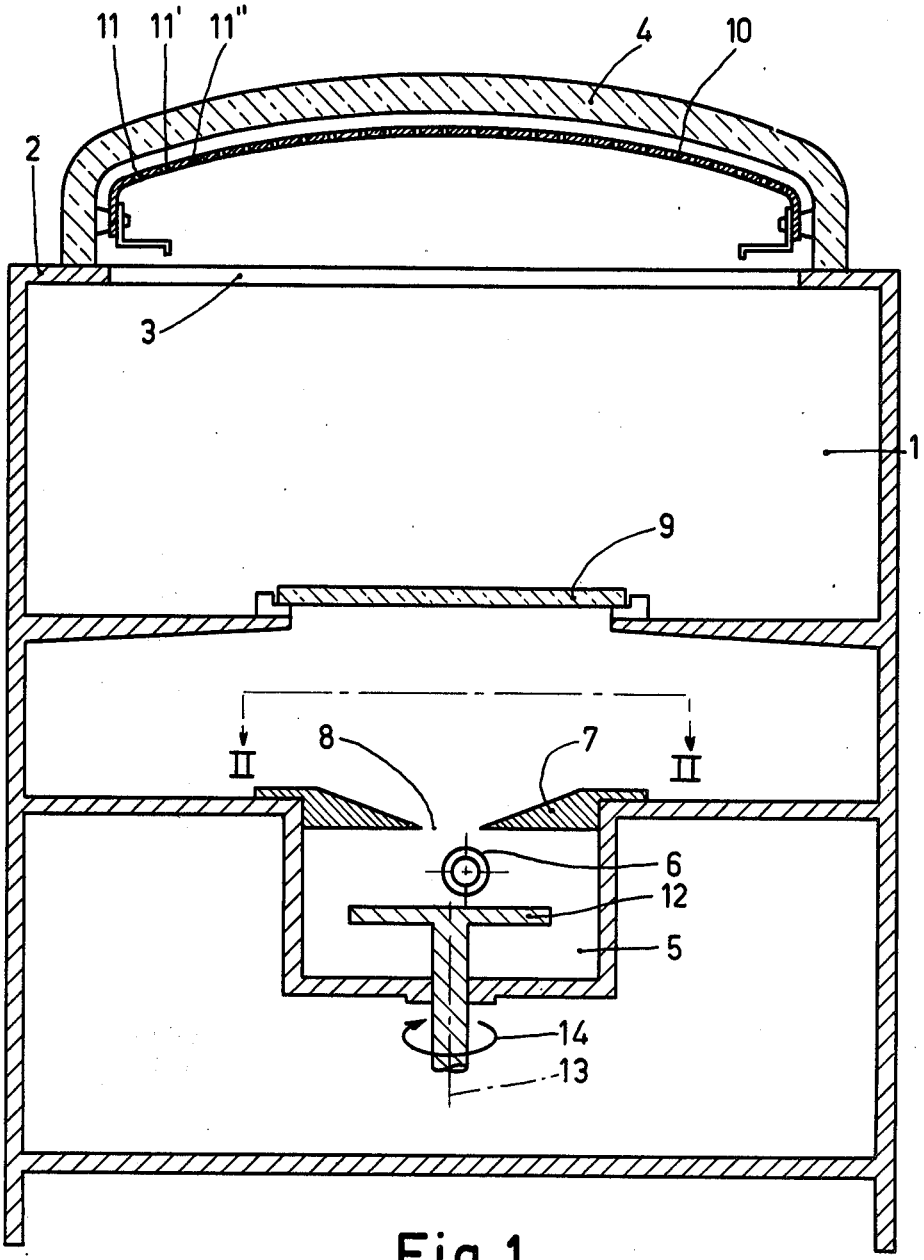

*INVENTORS*
CONSTANT J.M. GEENEN
JOHANNES C.A. VAN NES
*BY*
Frank R. Trifari
AGENT

*INVENTORS*
CONSTANT J.M. GEENEN
JOHANNES C.A. VAN NES
*BY*
Frank R. Trifari
AGENT

*INVENTORS*
CONSTANT J.M. GEENEN
JOHANNES C.A. VAN NES
*BY*
Frank R. Trifari
AGENT INVENTORS
CONSTANT J.M. GEENEN
JOHANNES C.A. VAN NES
BY
Frank R. Trifari
AGENT INVENTORS
CONSTANT J.M. GEENEN
JOHANNES C.A. VAN NES
BY
Frank R. Trifari
AGENT INVENTORS
CONSTANT J.M. GEENEN
JOHANNES C.A. VAN NES
BY
Frank R. Trifari
AGENT

METHOD OF OPTICALLY PROJECTING A PATTERN OF SUBSTANTIALLY CIRCULAR APERTURES ON A PHOTOSENSITIVE LAYER BY ROTATING LIGHT SOURCE

This is a continuation of Ser. No. 645,933, filed Jan. 2, 1976; which was a continuation of Ser. No. 494,816, filed Aug. 5, 1974; which was a continuation of Ser. No 355,273, filed Apr. 27, 1973; which was a continuation of Ser. No. 148,502, filed June 1, 1971, which are all now abandoned.

The invention relates to a method of optically projecting a light pattern of substantially circular apertures on a photosensitive layer applied onto a support. The invention furthermore relates to a device for carrying out this method.

In the manufacture of color television cathode-ray tubes such a method is used to project a pattern of substantially circular apertures in a mask onto a photosensitive binder provided on a support, which is usually the window of the cathode-ray tube. In this method, the exposed areas of the binder are hardened and the hardened areas are then successively provided with phosphors which upon excitation by electrons, luminesce in different colors. Alternatively the luminescent substances may be added to and applied with the photosensitive binder so that upon exposure, the phosphors will be fixed and adhere to the support in the hardened areas. Thus a pattern of phosphor dots is formed of each colour. During operation of the cathode-ray tube, a number of electron beams is produced corresponding to the number of differently luminescing phosphor substances. Due to the presence of the mask in the cathode-ray tube, each beam impinges only on one of the luminescent substances, while the remaining part of the beams are intercepted by the mask. Electron spots of a given electron beam are then formed on the dots of a given luminescent substance. Although the same mask that is used during operation of the cathode-ray tube for forming the electron spots is used during the provision of the dots, the dimension of the dots in practice is always larger than that of the electron spots. The reason for this is that it is not possible to form dots whose centers coincide with the centers of the electron spots over the entire display screen. In a tube with phosphor dots larger than the electron spots, even though the electron spot is offset from the center of the dot, the electrons passing through the apertures in the mask always impinge on the luminescent substance causing it to light up. During the optical projection of the mask aperture pattern onto the photosensitive layer, of the hardened areas of the layer should therefore be larger than the apertures in the mask which determine the size of the electron spot. This enlargement of the hardened areas occurs by penumbral effects. Moreover, in the case where the phosphors are dispersed in and applied with the photosensitive binder, the light in the photosensitive layer is scattered and even intensified during exposure resulting in additional enlargement of the hardened areas. During operation of such a cathode-ray tube, which usually has three different luminescent substances (red, green and blue), the remaining colours to be displayed are obtained by varying the contribution of the three luminescent substances by controlling the current intensity of the associated electron beams. The portion of the electron beams passing through the mask determine the size of each luminescent surface area, because that portion of the electron beams in principle always impinges upon a luminescent substance.

In the above-mentioned method, the size of the hardened areas of the photosensitive binder is dependent, inter alia, on the light source of the lamp. A "light source" of a lamp as used herein refers to a filament of a filament lamp or the part of a lamp in which a discharge takes place, for example, that part of the discharge space of a gas discharge tube which coincides with the arc. A gas discharge is particularly suitable for hardening a photosensitive binder because of is spectral energy distribution and light intensity. In optical projection of a substantially circular aperture onto a photosensitive layer, theoretically, a substantially circular area of the layer will be hardened only if the light source is punctiform or at least substantially rotationally symmetrical. Since the arc of a gas discharge tube is ribbon-shaped, a conical element is usually incorporated between the lamp and the layer of binder. The conical element is positioned so that its vertex is facing the support and its base is adjacent the lamp. Part of the light entering the element at the base is concentrated at the vertex by reflection from the walls of the cone so that the vertex of the cone effectively acts as a light source of a shape determined by the shape of the vertex. One of the drawbacks in using such a conical element is that it reduces the optical efficiency of the system since some of the light is absorbed by the conical element and part of the light leaves the cone through the walls. As a result of this, the required exposure time is rather long.

In such manufacture of picture display screens for cathode-ray tubes, a correction lens disposed between the light source and the photosensitive layer is also used to ensure that the centers of the hardened areas coincide as closely as possible with the centers of the electron spots during operation of the tube. As previously stated, a complete coincidence of the centers over the entire picture display screen, however, cannot be realized in practice.

It is known to separate the surfaces of the phosphor substances which, upon excitation by electrons, luminesce in different colors, by a light-absorbing material. One advantage of such a picture display screen is that for a given contrast, the tinting of the window glass may be omitted or at least the degree of tinting may be less so that the observed brightness of the picture is increased. One picture display screen of this type is described in the U.S. Pat. No. 3,146,368, in which the circular phosphor dots on the window are separated by a light-absorbing material. Moreover, the apertures in the mask of the cathode-ray tube described in the patent are larger than the apertures or voids in the light-absorbing layer. During operation of the tube with the mask and the display screen at the same potential, the electron spots are larger than the effective phosphor dots so that a portion of the electrons of a given beam passing through a given aperture in the mask, impinges fully upon the associated phosphor dots, while the remaining electrons impinge upon the surrounding light-absorbing material. In contrast with the cathode-ray tube described earlier, in this case it is not the size of the electron spots but the size of the effective phosphor dots that determines the size of each luminescent surface area.

The light-absorbing layer may be provided by several methods, the basic difference between them being the stage at which the light absorbent material is applied, namely whether it is applied prior to or after the provision of the luminescent substances. If the light-absorbing layer is provided first, which is the preferred method, the light-absorbing layer is formed on the support with voids at the regions where the luminescent substances are to be subsequently applied. In this case the size of the voids in the light-absorbing layer determines the size of the phosphor dots contributing to a picture display. Since in the cathode-ray tube described in the preceding paragraph, it is the size of an effective phosphor dot that determines the size of the luminescent surface, the size of the voids in the light-absorbing layer thus determines the size of the luminescent surface area. The light-absorbing layer with the apertures should for that reason by provided with very great care. Since the apertures in the mask of the cathode-ray tube are larger than the effective phosphor dots, the apertures in the mask are therefore also larger than the voids in the light-absorbing layer. The light-absorbing layer with the voids is formed by a photographic process and, in particular, by optically projecting the pattern of substantially circular apertures in the mask on a layer of photosensitive binder provided on the window of the tube. In the case of three luminescent substances, this process is carried out three times. As regards the realization of voids in the light-absorbing layer which are smaller than the apertures in the mask, the only reference in U.S. Pat. No. 3,146,368 is that the size of the light source is chosen to be such that on the basis of penumbral effects, which are known in the photographic engraving technology, areas of suitable size can be obtained by controlling the exposure time. There are several possible methods for obtaining a light-absorbing layer with voids by optically projecting a pattern of substantially circular apertures in a mask onto a photosensitive binder on a support. One way of doing this is to use a photosensitive binder which is rendered soluble in a solvent upon sufficient exposure whereas the regions of the binder which are not exposed or insufficiently exposed remain insoluble. In such a method the light-absorbing substance is adhered to those parts of the photosensitive layer which are unexposed or insufficiently exposed. Another method uses a photosensitive binder which becomes insoluble when sufficiently exposed whereas the unexposed or insufficiently exposed areas of the binder are soluble in a given solvent. In this method, the regions of the binder where the voids should be present in the light-absorbing layer are hardened by sufficient exposure. The areas which are unexposed or insufficiently exposed are then dissolved leaving behind hardened binder dots in the areas where the voids should be present in the final light absorbent layer. A suspension of a light-absorbing substance is then applied onto the support and adheres readily to the uncovered portions of the support and possibly also to the hardened binder dots. The hardened binder dots are then removed by a chemical decomposition as a result of which the light-absorbing substance present thereon is also removed leaving a light-absorbing layer with voids which are subsequently filled with luminescent substances.

It is known from "Journal of the Society of Motion Picture and Television Engineers," vol. 65, nr. 8, August, 1956, pp. 407–410 that during the optical projection of a substantially circular aperture onto a layer of binder provided on a support, the size of the exposed regions depends upon the dimensions and the distribution of the light intensity of the light source. Because of penumbral effects there is a transitional region between the area exposed to light from the entire light source and the unexposed regions. When a circular light source is used, the area exposed to light from the entire light source decreases with the diameter of the light source, while the surrounding transitional region is exposed to light from an ever decreasing portion of the light source. In this manner a pyramid-like intensity distribution is formed behind the mask hole. For a source with a given light intensity, the desired hardening can be obtained for a given region of the layer by controlling the exposure time. The provision of a light-absorbing layer with voids which are smaller than the apertures in the mask, requires a circular light source with a comparatively large diameter. It is also known, however, that in the case of a large light source, the size of the hardened region is very sensitive to the exposure conditions. The use of an annular light source of suitable dimensions produces larger light intensity gradients in the penumbral region. As a result, control of the hardened area is less dependent on variations in the exposure and the sensitivity. In the case of an annular light source having a constant outside diameter, a more stepwise transition, from the region exposed to light from the entire light source to the unexposed region occurs with increasing inner diameter.

It has been found, however, that, in addition to the fact that the use of a conical element, such as that described previously, has the drawback of a rather long exposure time, such a conical element cannot be used to form a large diameter annular or nonannular light source of the desired characteristics. For example, in the case of a cone with a comparatively large vertex diameter, the peak of the light intensity distribution behind the aperture, i.e. the microscopic light distribution, cannot be made sufficiently narrow. Furthermore, the microscopic light distributions behind the mask holes, measured along a circle concentric with the center of the screen, are not sufficiently uniform since the distribution about the circle vary by 10 to 40% from an average value. This means that the macroscopic light distribution throughout the mask is not sufficiently rotationally symmetrical. It is of great importance for the macroscopic light distribution to be rotationally symmetrical, since it is then possible by means of a filter whose light transmittance varies as a function of the distance from the center, to obtain the ultimately desired homogeneous macroscopic light distribution. If, on the other hand, the macroscopic light distribution were not rotationally symmetrical, a rotationally asymmetrical filter would have to be used which, of course, has great drawbacks. An annular light source also cannot be realized by means of a conical element.

The invention obviates these drawbacks and provides a method and a device which produces both the desirable rotationally symmetric macroscopic light distribution and the desired microscopic light distribution having a large light intensity gradient in the penumbral region and a narrow top. According to the invention, the lamp comprising the light source rotates about an axis which is substantially perpendicular to the support carrying a layer of photosensitive material. As a result of the rotation of the lamp, the macroscopic energy distribution is rotationally symmetrical relative to the axis of rotation of the lamp, and moreover produces a substantially rotationally symmetric microscopic light distribution. A rotationally symmetric microscopic energy distribution is of essential importance in the manufacture of a layer of a light-absorbing substance with voids which determine the size and, hence, contributions by a luminescent substance subsequently provided in the apertures.

Various possibilities are available now. If an elongated light source is used and the longitudinal axis of the light source and the axis of rotation intersect each other, a circular light source is effectively produced. If on the other hand, the longitudinal axis of the elongated light source and the axis of rotation do not intersect, an annular light souce is produced whose diameter is dependent upon the eccentricity. In either of these cases, the size of the effective light source can be restricted by positioning between the lamp and the support an intermediate member having a substantially circular aperture so that the light path from the light source of the lamp to the aperture in the mask passes through the aperture in the intermediate member. If a substantially punctiform light source is used, the method according to the invention provides a means for obtaining an annular light source by arranging the axis of rotation outside the center of the punctiform light source. In a light source thus formed, which is effectively larger than the real light source and in certain cases is annular, the microscopic light distribution behind the mask holes is particularly favorable for the case in which a pattern of substantially circular apertures smaller than the mask holes should be realized. Moreover, the effective, or apparent, light source thus formed is particularly advantageous in the case where a pattern of substantially circular apertures is projected optically onto the photosensitive layer a number of times from different positions. This occurs during the manufacture of an light-absorbing layer with voids for a picture display screen for a color display tube. The voids in the light-absorbing layer of such a screen are at the positions where the phosphor dots are to be provided on the support. If the picture display screen is formed by three differently luminescing substances, the pattern of apertures in the mask has to be projected optically on the same photosensitive layer three times during the manufacture of the light-absorbing layer. This layer has a very large number of hardened areas each surrounded by an area which although exposed is insufficiently hardened. The part of the layer of binder which is exposed to light but is not sufficiently hardened to render it unsoluble, should not, during a subsequent optical projection of the pattern of apertures in the mask, be subjected to an exposure which, although in itself would not result in a sufficient hardening, would harden the binder due to the cumulation of exposures. This imposes upon the microscopic light distribution behind the mask hole, the requirement that the sum of the light energy incident on the intermediate regions should be considerably lower than the energy level in the areas which are to be hardened. The invention is particularly suitable for projecting a pattern of substantially circular apertures a number of times on different parts of a photosensitive layer by means of an elongate light source whose longitudinal axis does not intersect the axis of rotation. The invention furthermore relates in particular to a method for projecting a pattern of substantially circular apertures a number of times on different parts of a photosensitive layer on a support, by means of a lamp having a substantially punctiform light source which is rotated about an axis which lies outside the center of the light source.

A preferred embodiment of a device according to the invention, for optically projecting a pattern of substantially circular apertures on a photosensitive layer on a support comprises a lamp having an elongated light source rotatable about an axis which is substantially perpendicular to the center of the support and which either intersects or does not intersect the longitudinal axis of the light source. The device further comprises a sheath-like light screen, the longitudinal direction of which light screen is substantially parallel to the longitudinal axis of the light source. The light screen comprises a gap the curved center line of which lies in a plane substantially perpendicular to the longitudinal axis of the light source.

By using a rotating lamp with a co-rotating light screen, a highly rotationally symmetric macroscopic light distribution is obtained. It should be noted that the light distribution in connection with the rotation of the lamp is not to be considered momentarily but is to be averaged over the exposure time which lasts many revolutions of the lamp. The microscopic light distributions behind the various mask holes in the method according to the invention also have the desirable narrow peak and large light intensity gradient in the penumbral regions.

In a device according to the invention, the gap of the light screen preferably widens in the direction from the center of the gap towards the two ends of the gap.

Actually, the result of a gap having a constant width is that points on the screen which are located at some distance from the center see less of the light source on an average over the exposure time than points of the screen in the neighborhood of the center. If on the other hand, the gap widens toward the ends, the points at some distance from the center of the screen receive more light whereas points in the neighborhood of the center, viewed from which the light source is present substantially behind the center of the gap, receive an unchanged quantity of the light. As a result of this a much more homogeneous macroscopic light distribution is obtained and a much weaker filter may be used, which considerably reduces the exposure time.

The device according to the invention preferably further comprises a cylinder lens the axial direction of which is substantially parallel to the longitudinal direction of the light source of the lamp.

Since the light source is not located in the plane of the gap, a varying screening of the light source by the gap occurs during the rotation of the lamp as viewed from a given point on the mask. The result on this is that, if the line connecting that point and the center of the gap lies in a plane which comprises the curved center line of the gap, the apparent light source is present in the place of the actual light source. If the light source has rotated 90° with the gap, the apparent light source is in the plane of the gap, the light then originating from a part of the actual light source present obliquely behind the gap. These apparent variations in place which mean radial and tangential variations in the place of the effective source relative to is axis of rotation, would seriously disturb the rotational symmetry of the microscopic light distributions. This can be checked by displacing the light source by means of the cylinder lens apparently over a small distance in the direction of the center of the gap, namely in planes perpendicular to the longitudinal axis of the lamp.

Figure 2:
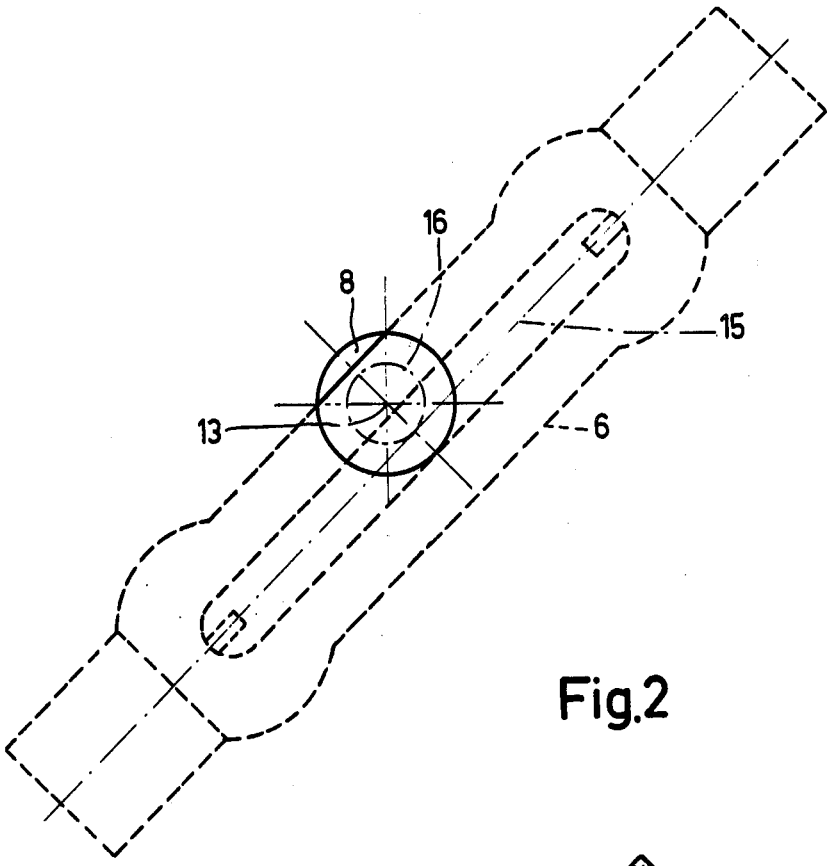
Figure 4:
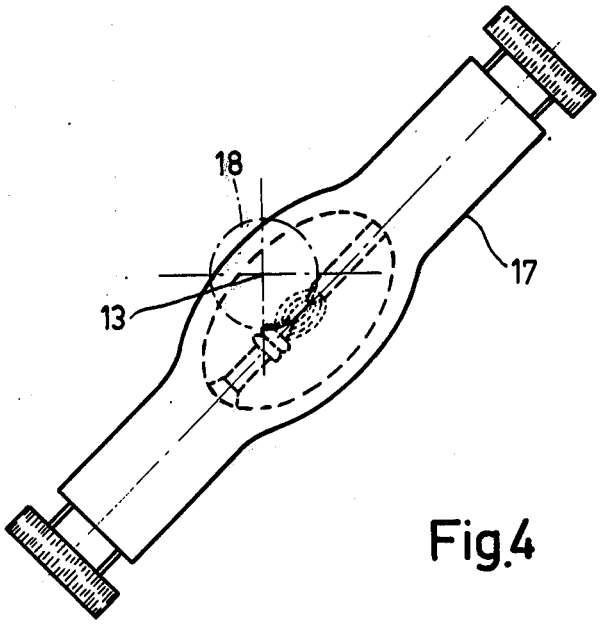
Figure 3:
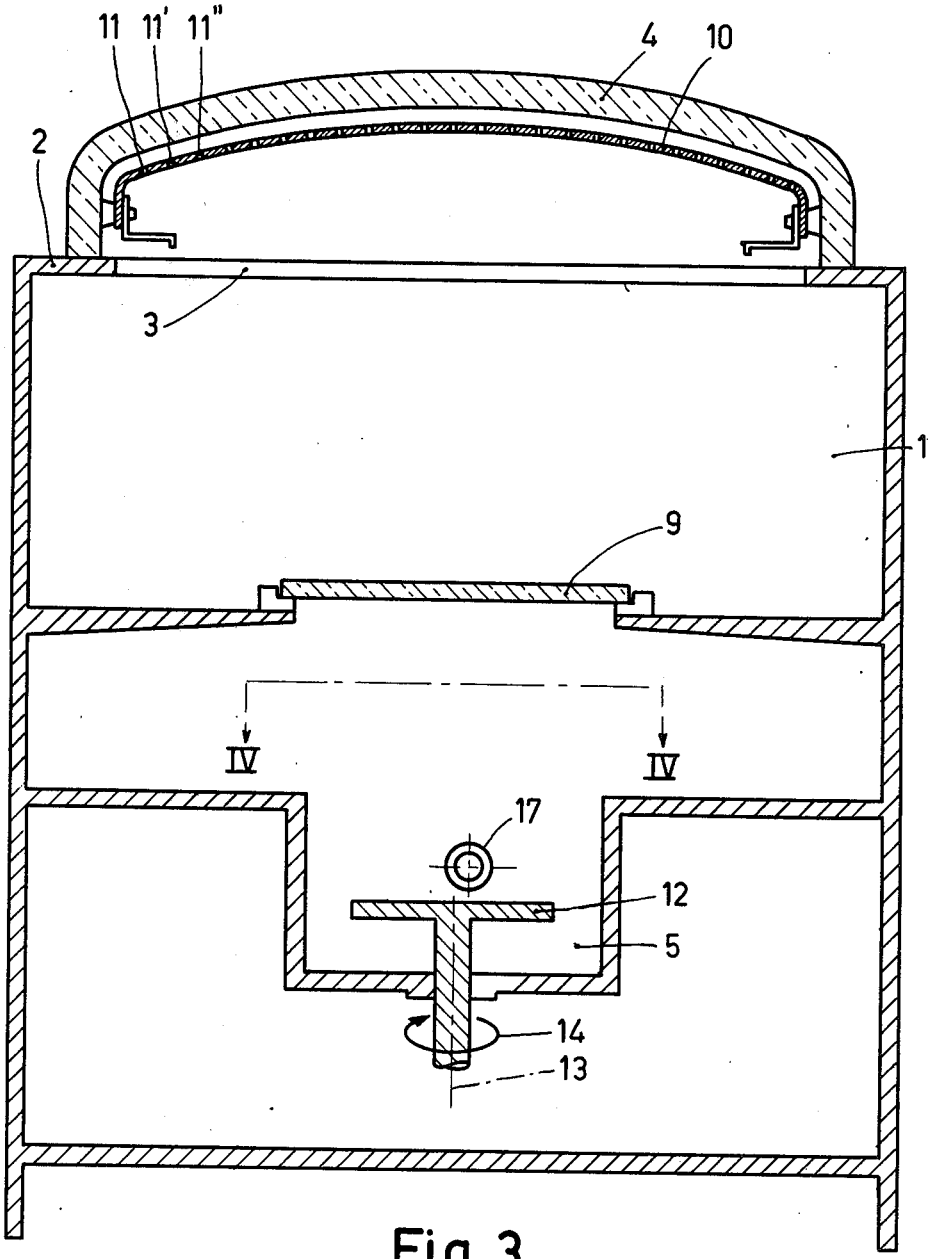
Figure 5:
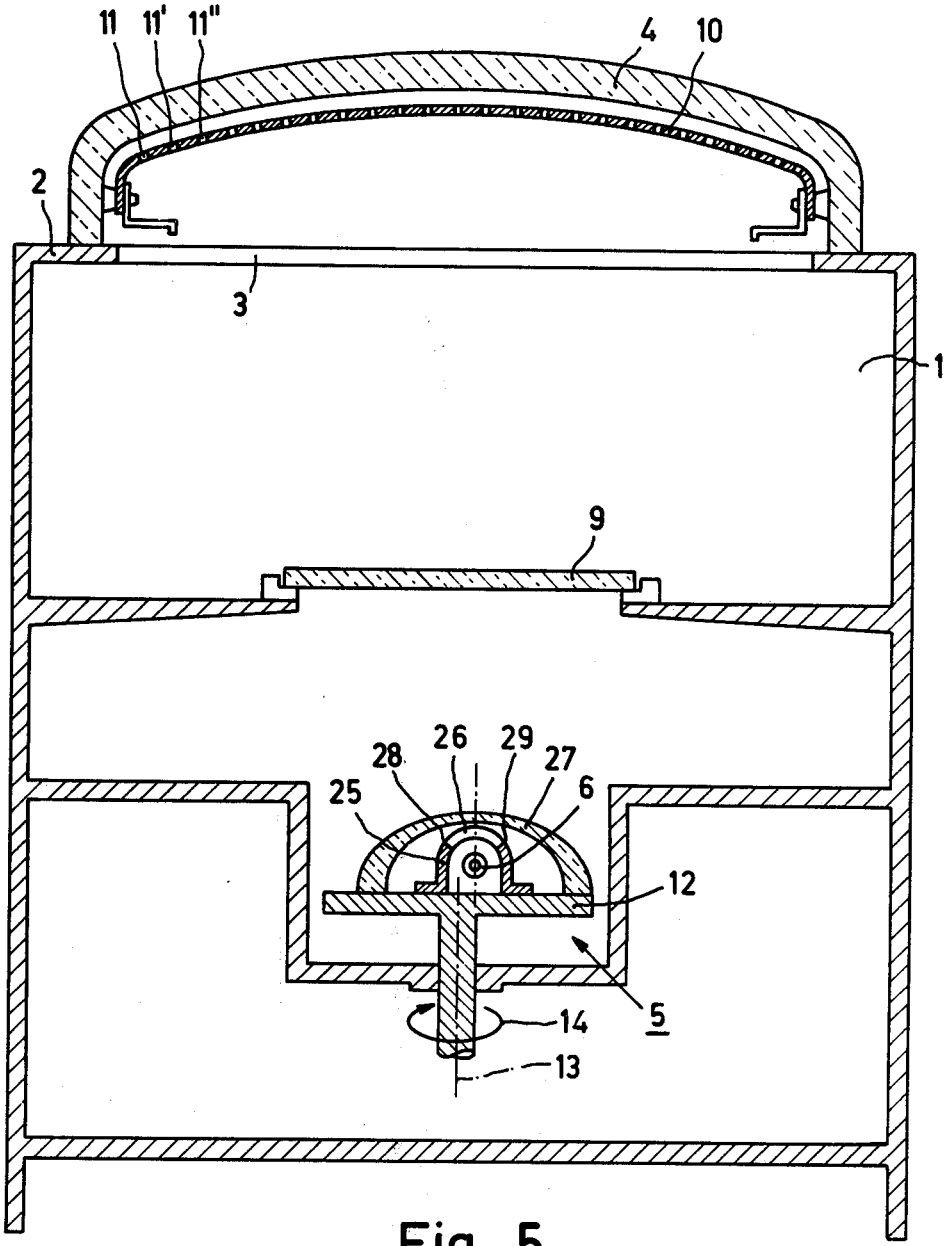
Figure 6:
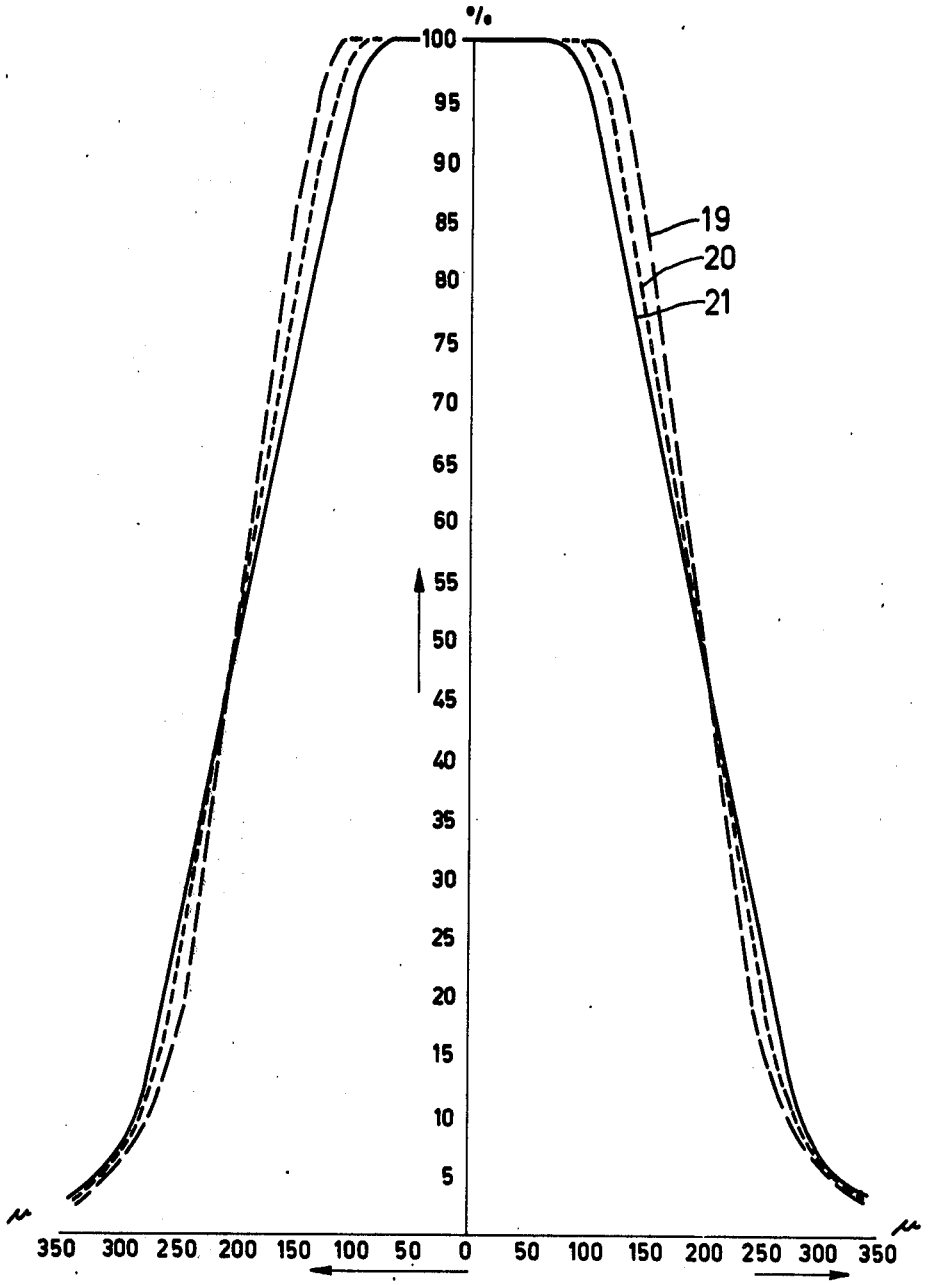
Figure 7:
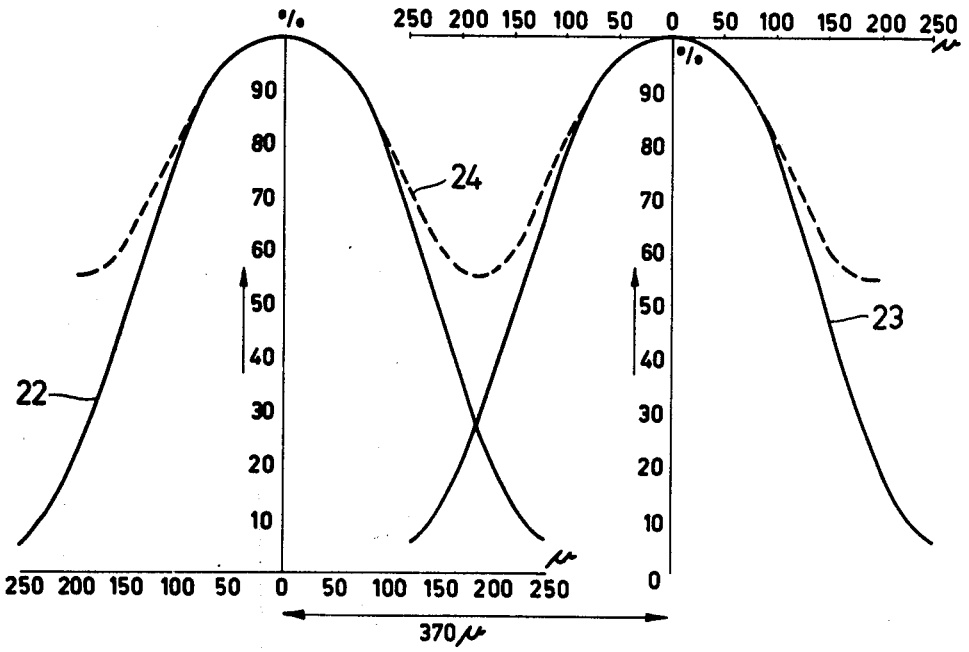

In order that the invention may be readily carried into effect, it will now be described in greater detail, by way of example, with reference to the accompanying drawings, in which:

FIG. 1 is a diagrammatic cross-sectional view of an exposure apparatus for using the method according to the invention, FIG. 2 is a part cross-sectional view of FIG. 1, FIG. 3 is a diagrammatic cross-sectional view of an exposure apparatus for using the method according to the invention, FIG. 4 is a part cross-sectional view of FIG. 3, FIG. 5 is a diagrammatic cross-sectional view of an exposure apparatus according to the invention, FIG. 6 shows microscopic light distributions behind a mask hole, FIG. 7 shows the microscopic light distribution behind a mask hole with two exposures.

Referring now to FIG. 1, which is a diagrammatic cross-sectional view of an exposure apparatus for carrying out the method of the invention. The apparatus includes a substantially closed tray or housing 1 provided on its upper side with a closable top 2 having an aperture 3. A window 4 on which the picture display screen of a color television tube is to be provided is disposed on the top 2. The position of the window 4 on the top 2 is determined by studs (not shown). The side of the window 4 facing the aperture 3 is covered with a layer of photosensitive binder (now shown). A device 5 comprising a high-pressure mercury vapour discharge lamp 6 is arranged in the housing 1. The light from the lamp passes through the circular aperture 8 of a diaphragm 7 and is radiated in the direction of a correction lens 9. The light passes through the correction lens 9, the aperture 3, apertures 11, 11', 11'' and so on in a mask 10, and impinges on the photosensitive binder on window 4. The lamp 6 is secured to a platform 12, with the aid of means which are not shown in the cross-sectional view. The platform 12 can be rotated about its axis 13 as shown by arrow 14. As shown in FIG. 1, the lamp 6 is arranged eccentrically relative to the axis of rotation 13. FIG. 1 is a cross-sectional view perpendicular to the longitudinal axis of the lamp 6. The lamp 6 has an elongate light source. The axis of rotation 13 passes through the center of the circular aperture 8 of the diaphragm 7.

FIG. 2 is a partial cross-sectional view of the apparatus shown in FIG. 1, taken on the line II—II. A portion of the lamp 6 is visible through the circular aperture 8 of the diaphragm 7. The center line 15 of the lamp 6 coincides with the axis of the elongate light source. During rotation of the lamp about the axis 13, the axis 15 of the lamp touches the circle 16.

In a given case, the discharge of the lamp has a length of 17 mm and a width of 2 mm. The inside diameter of the lamp is adapted to the width of the discharge and, therefore, is also 2 mm. The outside diameter of the lamp in the center is 16 mm. The diaphragm 7 has a circular aperture having a diameter of 4.5 mm. In this manner the size of the effective light source is restricted. This is necessary because the discharge has a length of 17 mm. The center line of the lamp 15 is 3.5 mm below the aperture in the diaphragm 7. The eccentricity of the light source, i.e. the distance between the center line 15 of the lamp 6 and the axis of rotation 13, is 1.2 mm. The distance from the aperture 8 in the diaphragm 7 to the window 4 is in the center 350 mm, while the distance between the window 4 and the mask 10 in the center is 14.7 mm. The speed of rotation of the platform 12 is two revolutions per second with exposure times varying from 2 to 5 minutes.

FIG. 3 is a diagrammatic cross-sectional view of another exposure apparatus for carrying out the method of the invention. The difference from the exposure apparatus shown in FIG. 1 is that the lamp 17 has an approximately punctiform arc discharge and there is no diaphragm. The remaining component are identified by the same reference numerals as used in FIG. 1. With the aid of means not shown in the cross-sectional view, the lamp 17 is mounted on the platform so that the center of the light source is eccentric relative to the axis of rotation 13.

FIG. 4 is a part cross-sectional view of the apparatus shown in FIG. 3 taken on the line IV—IV. During rotation of the lamp 17 about the axis 13, the center of the approximately punctiform light source describes a circle 8.

In a given case, the approximately punctiform discharge has a dimension of 0.8 mm. The eccentricity of the light source, i.e. the distance between the center of the light source and the axis of rotation 13, is 1.6 mm. The distance from the center of the light source to the center of the window 4 (FIG. 3) is 350 mm, while the distance between the window 4 and the center of the mask 10 is 14.7 mm.

In FIG. 5, which is a diagrammatic cross-sectional view of a preferred embodiment of an exposure apparatus according to the invention, the lamp 6 has an elongated light source and is surrounded by a diaphragm 25 having a gap 26. The diaphragm is secured to the platform 12 and hence co-rotating with the lamp 6. A negative cylinder lens 27 provides an apparent displacement in the plane of the drawing, of the lamp 6 to approximately the gap 26. In planes perpendicular to the plane of the drawing, the strength of the cylinder lens 27 is substantially zero. The gap 26 extends in the plane of the drawing and its width is perpendicular to that plane. The gap has a shape such that the desired macroscopic and microscopic light distributions are obtained. For that purpose, the gap widens perpendicularly to the plane of the drawing of FIG. 5, preferably in the direction from the center towards the ends 28 and 29.

FIG. 6 shows three microscopic light distributions which are obtained by means of an exposure apparatus according to the invention behind a mask hole in the center of the mask having a diameter of 420 microns. The radius of the light distribution is plotted in the horizontal direction and the relative brightness, i.e. the brightness related to that which is measured in the center behind the mask hole, is plotted in the vertical direction. The broken line 19 shows the distribution obtained with an eccentricity of 0.4 mm, the dotted line 20 with an eccentricity of 2.4 mm and the solid line 21 with an eccentricity of 1.8 mm. The light distributions are rotationally symmetric and as shown in FIG. 6 that, when the eccentricity increases, the peak of the light distribution becomes narrower while it widens in the neighborhood of the base. The actuat base always remains the same for this is determined by the dimension of the aperture in the diaphragm.

FIG. 7 shows the summation of two microscopic light distributions behind one mask hole in the center of the mask of the line joining the centers of two parts exposed from two different positions. This is obtained by means of an exposure apparatus shown in FIGS. 1 and 2, in which the diaphragm has a circular aperture of 5 mm, the eccentricity of the light source is 0.6 mm, the distance from the aperture 8 in the diaphragm 7 to the window in the center is 270 mm, the distance between the window 4 and the mask 10 in the center is 10 mm, and the mask hole 11, 11', 11'', etc., has a diameter of 330 microns. The radius for each light distribution is plotted in the horizontal direction and the relative brightness, i.e. the brightness related to that which is measured for an exposure centrally behind a mask hole, is plotted in a vertical direction. The solid line 22 denotes the microscopic light distribution of one exposure and the solid line 23 denotes the microscopic light distribution of the other exposure. The broken line 24 denotes the light distributions 22 and 23. That the shape of the lines 22 and 23 in FIG. 7 differs from that of the lines 19, 20 and 21 of FIG. 5, which means that the microscopic light distributions are different, is a result of a difference in geometry.

What is claimed is:

1. A method of making a display screen for a color picture tube having an apertured shadow mask, said method comprising the steps of (a) coating one surface of a window part of the tube with a photosensitive substance, (b) supporting the window part and the shadow mask in a spaced relationship with the mask positioned adjacent said one surface, (c) exposing said photosensitive coating through the apertures in the shadow mask to light from a light source spaced from said mask to thereby project onto said photosensitive coating a light pattern corresponding to the pattern of apertures in the mask, and (d) rotating said light source during said exposure of said photosensitive layer about an axis which is substantially perpendicular to the central portion of the window part so that the center of said light source describes a circle of a predetermined radius, said circle being concentric with said axis of each point of said light source being maintained at a fixed distance with respect to said axis during rotation to thereby produce a substantially rotationally symmetrical light intensity distribution at the areas of said projected light pattern corresponding to the apertures in the shadow mask.

2. The method according to claim 1 wherein said light source is elongated, and including the steps of positioning between said mask and said light source a diaphragm having an elongated aperture extending transversely of the longitudinal direction of said light source, and rotating said diaphragm together with said light source during said exposure.

3. The method according to claim 2 wherein the width of said aperture in said diaphragm increases from the center towards the ends of the aperture.

4. The method accorrding to claim 2 including the step of positioning between said diaphragm and said mask a cylinder lens with the cylinder axis parallel to the longitudinal direction of said light source and rotating said lens together with said diaphragm and light source during exposure.

5. The method according to claim 1 wherein said photosensitive substance is rendered insoluble in a solvent upon exposure to light and including the steps of dissolving, after said steps of exposure and rotation, the unexposed soluble regions of said coating, applying to the uncovered window part and the insoluble exposed areas of said photosensitive coating a layer of a light absorbing substance, removing said insoluble exposed areas to leave voids in said light absorbent layer and providing a luminescent substance in said voids of said layer.

* * * * *

UNITED STATES PATENT AND TRADEMARK OFFICE

CERTIFICATE OF CORRECTION

PATENT NO. : 4,152,154

DATED : May 1, 1979

INVENTOR(S) : CONSTANT J. M. GEENEN ET AL

It is certified that error appears in the above-identified patent and that said Letters Patent are hereby corrected as shown below:

Col. 9, line 34, "of" should be --and--

Signed and Sealed this

*Twenty-first* Day of *August 1979*

[SEAL]

*Attest:*

LUTRELLE F. PARKER

*Attesting Officer* *Acting Commissioner of Patents and Trademarks*